US005736820A

United States Patent [19]

Bardell

[11] Patent Number: 5,736,820

[45] Date of Patent: Apr. 7, 1998

[54] CAVITY ARRANGEMENTS

[75] Inventor: Steven Bardell, Dunmow, United Kingdom

[73] Assignee: EEV Limited, United Kingdom

[21] Appl. No.: 518,225

[22] Filed: Aug. 23, 1995

[30] Foreign Application Priority Data

Sep. 7, 1994 [GB] United Kingdom ..... 9418028

[51] Int. Cl.[6] ..... H01J 25/10

[52] U.S. Cl. ..... 315/505; 315/5.39; 315/5.35; 315/5.53; 315/5.46; 315/111.61; 315/111.71; 315/111.81; 250/423 R

[58] Field of Search ..... 315/505, 501, 315/5.35, 5.39, 5.53, 5.43, 5.46, 111.41, 111.51, 111.61, 111.71, 111.81; 250/423 R

[56] References Cited

U.S. PATENT DOCUMENTS

| | | | |
|---|---|---|---|
| 3,700,945 | 10/1972 | Friedman et al. | 315/5.39 X |
| 4,049,995 | 9/1977 | Edgcombe | 315/5.39 |
| 4,387,323 | 6/1983 | Berwick | 315/5.39 X |
| 4,404,494 | 9/1983 | Heynisch | 315/5.35 X |
| 4,558,258 | 12/1985 | Miyake | 315/5.39 |

FOREIGN PATENT DOCUMENTS

| | | |
|---|---|---|
| 946020 | 1/1964 | United Kingdom . |
| 1189640 | 4/1970 | United Kingdom . |

*Primary Examiner*—Ashok Patel
*Attorney, Agent, or Firm*—Spencer & Frank

[57] ABSTRACT

In an output resonant cavity used with a linear electron beam tube such as an IOT, magnetic material is mounted on walls of the cavity and defines annular channels within which coils are located to provide focusing of an electron beam travelling along the axis of a tube located in apertures in the cavity walls. An inner rim locates the electron beam tube with respect to the cavity.

16 Claims, 2 Drawing Sheets

CAVITY ARRANGEMENTS

FIELD OF THE INVENTION

This invention relates to cavity arrangements and more particularly to arrangements for use with linear electron beam tubes.

BACKGROUND OF THE INVENTION

A linear electron beam tube is a device, such as a klystron or an inductive output tube (IOT), in which an electron beam is generated to travel along a linear path and interact with high frequency energy at resonant cavities. In an IOT, for example, an annular input resonant cavity surrounds an electron gun and is arranged such that high frequency energy coupled into the cavity generates a modulating signal between the cathode and grid of the electron gun, hence density modulating the electron beam. After transmission along a drift tube, an amplified high frequency signal is coupled from an output resonant cavity located further along the electron beam path.

SUMMARY OF THE INVENTION

According to the present invention there is provided a cavity arrangement for use with a linear electron beam tube comprising: a resonant cavity having two walls with apertures therein through which in use the tube extends; and magnetic focusing means including magnetic material mounted on the outer surface of at least one of the two walls.

Magnetic focusing means is used with linear beam tubes to counteract the repulsion of electrons in the beam due to space charge effects and hence prevent impact of electrons on the parts of the tube surrounding the electron beam path.

By mounting magnetic material on the outer surface of the resonant cavity wall or walls, a more compact overall arrangement is provided compared to a conventional arrangement in which the magnetic focusing means is provided by completely separate items. The integration of the magnetic material with the cavity also facilitates assembly of the complete device as these components may be accurately aligned relative to one another and securely fixed together prior to combining them with the electron beam tube. Also, the number of components in the complete device is reduced, improving ease of handling and installation. The magnetic material may be mounted on the surface of the wall by a suitable glue or other fixing mechanism. The magnetic material is located outside the vacuum envelope of the electron beam tube and is separately mounted from the tube, giving good accessibility for servicing and the like The magnetic material may be carried on one wall only but in one embodiment of the invention magnetic material is carried on the outer surfaces of both cavity walls.

Preferably, the magnetic focusing means includes electromagnetic coil means. The coil means may be wound on the magnetic material or may be formed separately and positioned adjacent the magnetic material. In other alternative embodiments of the invention, the magnetic focusing means includes permanent magnetic material.

Where coil means is included, preferably, the magnetic material comprises a member having a first portion parallel to the wall surface and attached thereto and a second portion substantially normal to the surface. The magnetic member may also include a third portion substantially parallel to the surface and spaced therefrom to define an annular channel between it and the surface, and preferably coil means is located in the channel. In one embodiment of the invention, the magnetic member comprises a cylindrical wall having at an inwardly extensive flange which is secured to the cavity wall and its other end an outwardly extensive flange.

Advantageously, the magnetic material includes an inner projection extensive inside the aperture diameter which in use may be engaged with the electron beam tube to accurately locate it relative to the cavity and the focusing means.

According to a feature of the invention, a tube assembly comprises a cavity arrangement in accordance with the invention and a linear electron beam tube, which advantageously is an inductive output tube.

BRIEF DESCRIPTION OF THE DRAWINGS

One way in which the invention may be performed is now described by way of example with reference to the accompanying drawings in which.

DESCRIPTION OF A PREFERRED EMBODIMENT

Figure 1:
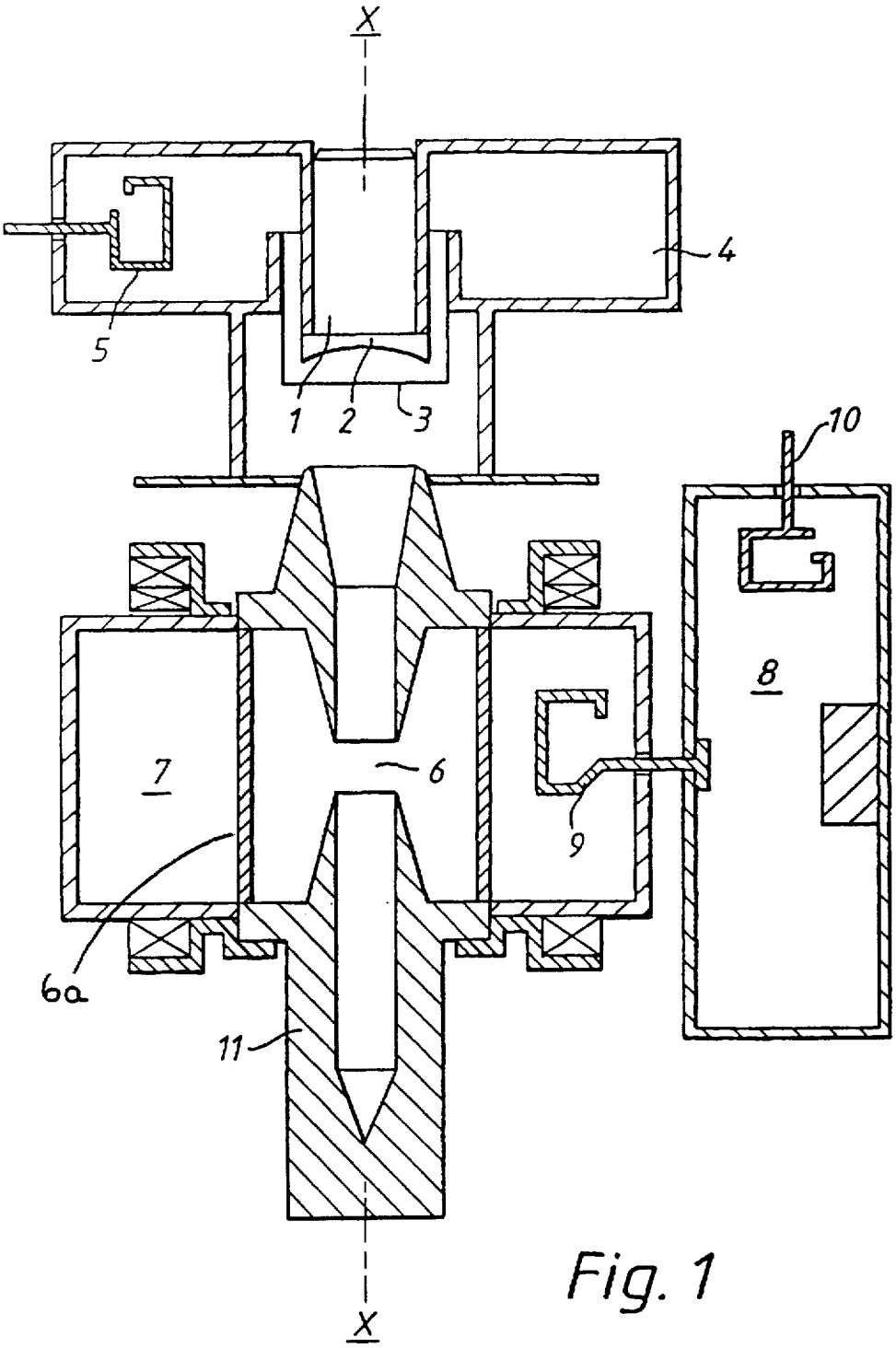
FIG. 1 is a schematic representation of an IOT assembly including a cavity arrangement in accordance with the invention.

With reference to FIG. 1, an IOT includes an electron gun 1 comprising a cathode 2 and grid 3 about which is located an annular resonant cavity 4 having a coupling loop 5 via which a high frequency signal may be coupled into the cavity 4. The electron beam produced by the gun 1 is arranged to travel along the longitudinal axis X—X of the tube through a drift region to a drift tube gap 6 surrounded by a non-conductive cylinder 6*a* which is transparent to high frequency radiation and defines a vacuum envelope. An output resonant cavity system 7 is provided which has a first portion located outside the non-conductive cylinder defining the vacuum envelope and a second portion located inside the non-conductive cylinder. An amplified high frequency output signal is coupled from cavity 7 into a secondary output cavity 8 via coupling means 9 and thence via coupling means 10 externally from the arrangement. A collector 11 is arranged to receive electrons of the beam after they have passed through the interaction region 6.

Figure 2:
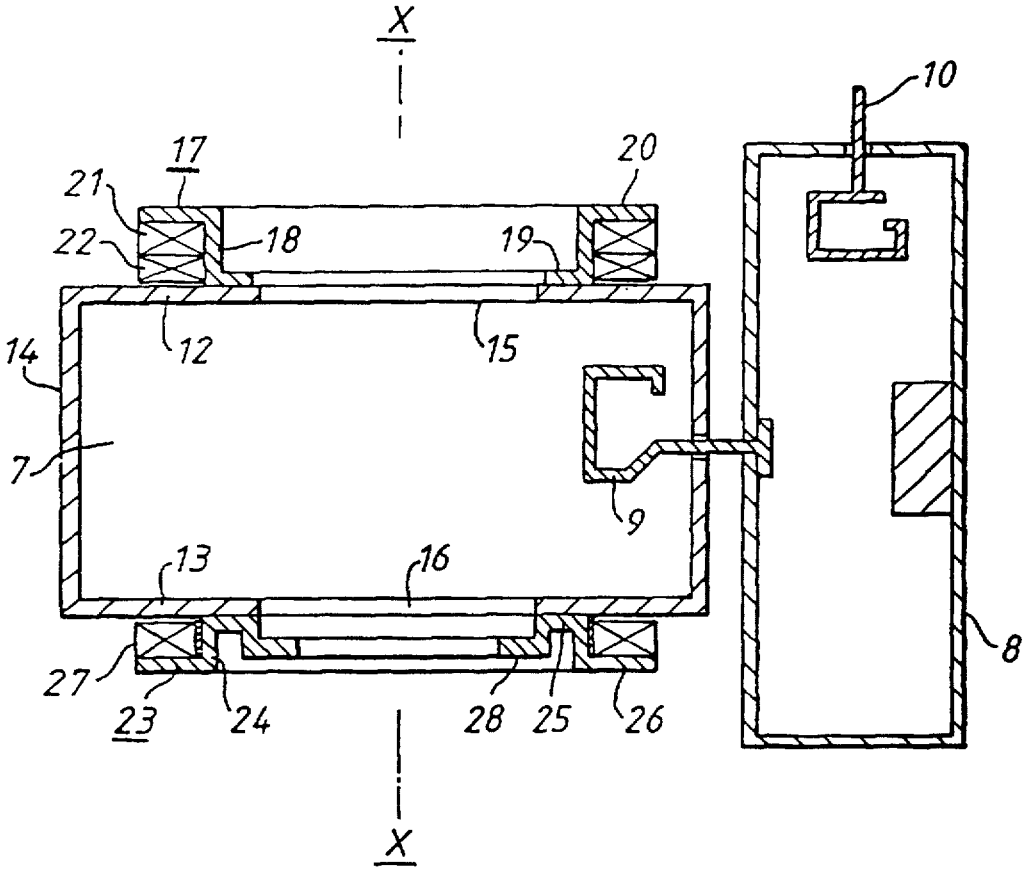
FIG. 2 shows schematically and in greater detail part of the assembly illustrated in FIG. 1.

With reference to FIG. 2, the output cavity 7 comprises two walls 12 and 13 substantially normal to the axis X—X and a wall 14 which joins them. The transverse walls 12 and 13 have apertures 15 and 16 respectively therethrough through which in use the tube extends. A first member 17 of magnetic material is located on the outer surface of cavity wall 12 and includes a cylindrical wall portion 18 extending parallel to the axis X—X and having an inwardly extensive portion 19 substantially parallel to the outer surface of the wall 12 and mounted thereon. It also includes an outwardly extensive flange 20 spaced from the wall 12 and substantially parallel thereto. Coils 21 and 22 are located in the annular channel defined by the flange 20, cylinder 18 and wall 12.

A second member 23 of magnetic material is fixed to the other transverse wall 13 and also includes a cylindrical wall portion 24 and inner and outer flanges 25 and 26. A coil 27 is located in the channel defined by the magnetic material 23 and the wall 13. The member 23 includes an inwardly projecting rim 28 extending inside the outer diameter of the aperture 16 and defining a ledge which locates the electron beam tube in the complete assembly relative to the output cavity 7 and the focusing means carried by it, the tube having a reduced diameter which engages with the rim 28.

The output cavity 7 is included in an external cavity system and has a first portion located outside the vacuum envelope and a second portion located inside the vacuum envelope.

I claim:

1. A cavity arrangement for use with a linear electron beam tube having a vacuum envelope comprising:

a resonant cavity having first and second portions, said resonant cavity being defined by first and second walls each having an outer surface, said walls having apertures therein through which in use said tube extends, the first portion of said resonant cavity being located outside the vacuum envelope of said linear electron beam tube and the second portion of said resonant cavity being located within said vacuum envelope; and magnetic focusing means mounted on the first portion of said resonant cavity, said magnetic focusing means including a member made of magnetic material mounted on the outer surface of at least one of said first and second walls, said magnetic focusing means being outside the vacuum envelope of said linear electron beam tube.

2. An arrangement as claimed in claim 1 wherein said magnetic focusing means includes electromagnetic coil means.

3. An arrangement as claimed in claim 2 wherein said coil means is wound on said magnetic material.

4. An arrangement as claimed in claim 1 wherein said member made of magnetic material comprises a first portion extending substantially parallel to said outer surface and attached thereto and a second portion extending in a direction substantially normal to said outer surface.

5. An arrangement as claimed in claim 4 wherein said member includes a third portion extending substantially parallel to said outer surface and spaced therefrom to define an annular channel between it and said outer surface.

6. An arrangement as claimed in claim 5 wherein said magnetic focusing means further comprises electromagnetic coil means, said electromagnetic coil means being located in said annular channel.

7. An arrangement as claimed in claim 1 wherein said magnetic material is arranged around the aperture in said at least one wall and includes a projection projecting inside the diameter of the aperture.

8. An arrangement as claimed in claim 7 wherein said projection is engagable in use with said tube to locate it in said aperture relative to said resonant cavity and said focusing means.

9. An arrangement as claimed in claim 8 wherein said magnetic focusing means further comprises electromagnetic coil means, said electromagnetic coil means being located adjacent said member of magnetic material.

10. An arrangement as claimed in claim 1 wherein said resonant cavity is an output cavity and including coupling means for coupling energy from said resonant cavity.

11. A linear electron beam tube assembly comprising:

a resonant cavity having first and second portions, said resonant cavity being defined by first and second walls each having an outer surface, said walls having apertures therein;

magnetic focusing means mounted on the first portion of said resonant cavity, said magnetic focusing means including a member made of magnetic material mounted on the outer surface of at least one of said first and second walls; and a linear electron beam tube having a vacuum envelope, said vacuum envelope extending through the apertures in said first and second walls into the second portion of said resonant cavity, the first portion of said resonant cavity and said magnetic focusing means being outside the vacuum envelope of said linear electron beam tube.

12. An assembly as claimed in claim 11 wherein said tube is an inductive output tube.

13. An assembly as claimed in claim 11 and wherein said magnetic focusing means includes electromagnetic coil means located adjacent said magnetic material.

14. An assembly as claimed in claim 13 wherein said magnetic material defines a channel in which said coil means is located.

15. An assembly as claimed in claim 11 and wherein said magnetic material is arranged around the aperture in one of said walls and includes a projection projecting inside the diameter of the aperture, said projection engaging said tube to locate it relative to said resonant cavity.

16. An assembly as claimed in claim 11 wherein said resonant cavity is an output cavity and includes means for coupling energy from said cavity.

* * * * *